US006106239A

United States Patent [19]

Wunner

[11] Patent Number: 6,106,239

[45] Date of Patent: Aug. 22, 2000

[54] AIR FLOW APPARATUS FOR LIQUID RING VACUUM PUMP

[75] Inventor: Charles H. Wunner, Charlotte, N.C.

[73] Assignee: Vooner Vacuum Pumps, Inc., Charlotte, N.C.

[21] Appl. No.: 09/187,799

[22] Filed: Nov. 6, 1998

Related U.S. Application Data

[60] Provisional application No. 60/066,032, Nov. 14, 1997.

[51] Int. Cl.[7] ..... F04C 19/00

[52] U.S. Cl. ..... 417/68

[58] Field of Search ..... 417/68

[56] References Cited

U.S. PATENT DOCUMENTS

| | | | |
|---|---|---|---|
| 1,766,591 | 6/1930 | Bingham | 417/68 |
| 3,846,046 | 11/1974 | Roe et al. | 417/54 |
| 4,521,161 | 6/1985 | Olsen et al. | 417/68 |
| 4,545,730 | 10/1985 | Lubke | 417/68 |
| 4,755,107 | 7/1988 | Trimborn | 417/68 |
| 4,756,672 | 7/1988 | Trimborn | 417/68 |
| 5,222,869 | 6/1993 | Wunner et al. | 417/68 |
| 5,246,348 | 9/1993 | Wallace et al. | 417/68 |
| 5,290,152 | 3/1994 | Wallace et al. | 417/68 |
| 5,328,274 | 7/1994 | Wallace et al. | 384/428 |
| 5,423,614 | 6/1995 | Wunner et al. | 384/428 |

*Primary Examiner*—Teresa Walberg
*Assistant Examiner*—Vinod D Patel
*Attorney, Agent, or Firm*—Dougherty & Associates

[57] ABSTRACT

A liquid ring vacuum pump or compressor includes an off-centered housing and a rotor shaft assembly within the housing. The liquid ring vacuum pump or compressor also includes a port-containing one member having a frustoconical shape positioned in the rotor. The rotor rotates liquid around the cone member forming an off-centered cylindrical liquid ring that is shaped by and centered in the off-centered housing. The invented cone member has an inlet port having a parabolic shaped opening edge and a discharge port having a parabolic shaped closing edge. The invented cone member fully supports the liquid ring, at the intersection of the inner surface of the cylindrical liquid ring and the outer surface of the wall of the frustoconical cone member and inhibits the flow of water into the ports, maximizes the amount of gas being displaced through the cone member, increases the capacity of the liquid ring vacuum pump, and reduces the cost of operating the pump. A method of reducing water usage in a liquid ring vacuum pump is also disclosed.

13 Claims, 8 Drawing Sheets

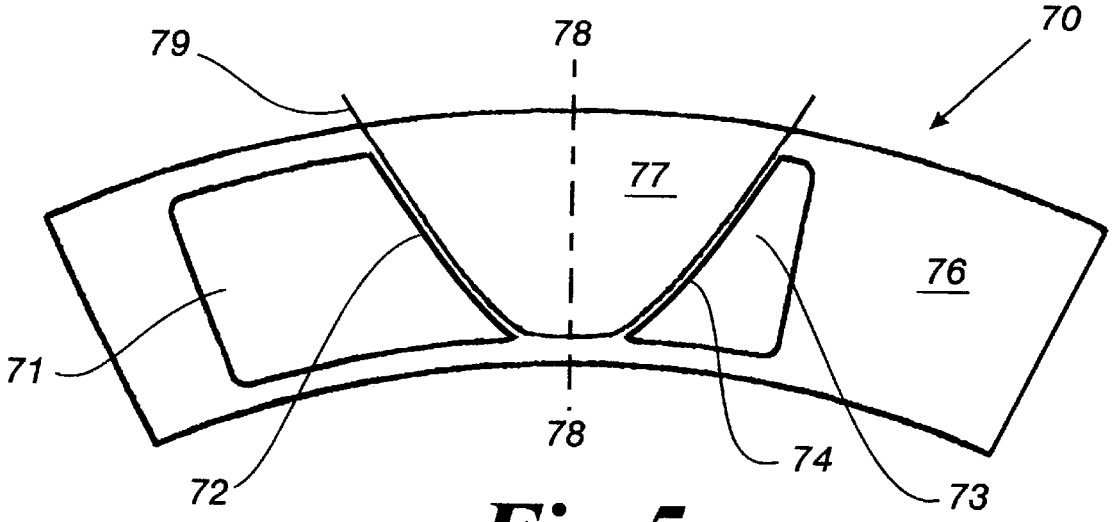
Fig.5
Fig.6
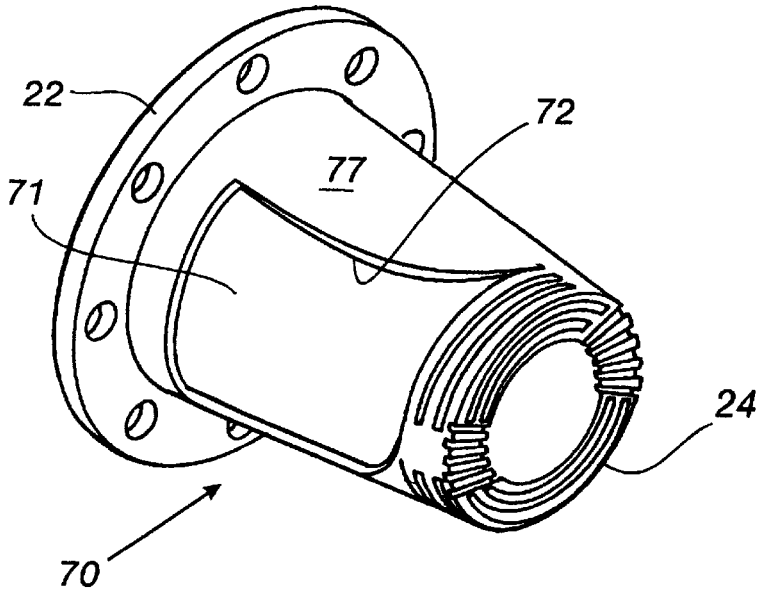

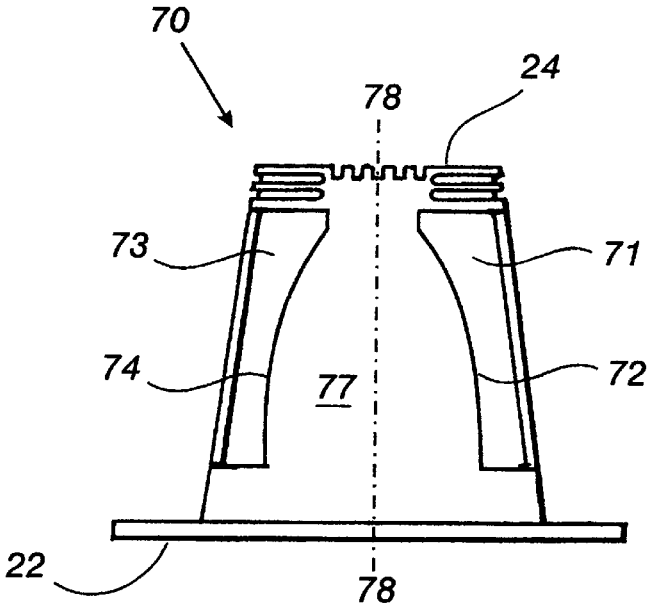
Fig. 7
Fig. 8
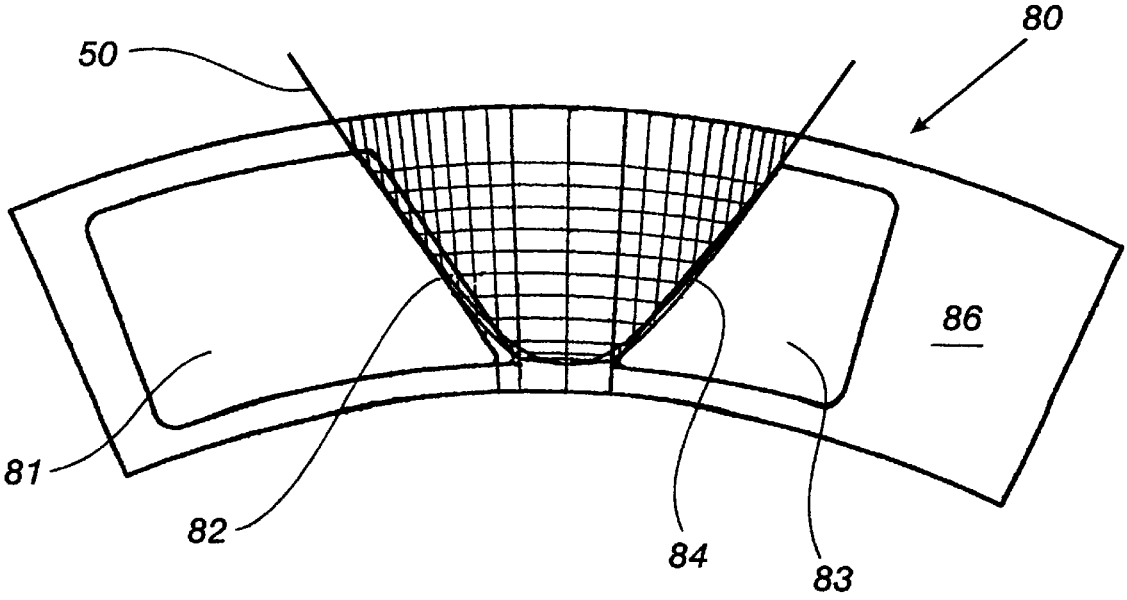

AIR FLOW APPARATUS FOR LIQUID RING VACUUM PUMP

CROSS REFERENCE TO RELATED APPLICATION

This application claims the benefit of U.S. Provisional Application Ser. No. 60/066,032 filed Nov. 14, 1997.

FIELD OF THE INVENTION

The present invention relates to an apparatus and method for maximizing the positive displacement of a gas such as air through a liquid ring vacuum pump. More particularly, this invention relates to a port-containing cone member having a cone seal segment that fully supports the portion of a cylindrical liquid ring that contacts the cone member thereby increasing liquid ring vacuum pump operating capacity and reducing liquid ring vacuum pump operating costs attributed to water and power.

BACKGROUND OF THE INVENTION

Liquid ring vacuum pumps typically have a housing with two port-containing cone members positioned inside each end of a rotor, although the pump can have just a single cone and rotor. Port-containing cone members have a large base end, a small end opposite the base end, and a cone wall extending between the large base end and the small end. Typically, the cone wall is tapered between the large base end and the small end thereby giving the port-containing cone member a frustoconical shape.

The rotor, which is coaxially mounted with the cone axis, rotates around the two port-containing cone members. Rotation of the rotor causes seal water located in the housing to form a cylindrical liquid ring that is shaped by the rotation of the rotor within the off-centered housing. In operation, movement of an off-centered cylindrical liquid ring around the port-containing cone member creates a disparity of volumes, and therefore varying pressures, around the port-containing cone member. The liquid ring acts like working pistons to reduce the volume and thereby increase the pressure of a gaseous medium within the liquid ring vacuum pump. The resulting disparate pressures force the gaseous medium to be positively displaced from an inlet port of the liquid ring vacuum pump, compressed by the cylindrical liquid ring or liquid ring pistons and then forced out through a discharge port in the liquid ring vacuum pump.

The port-containing cone member can be described as having an intake or inlet segment, a compression segment, a discharge segment, and a cone seal segment located between the discharge segment and the inlet segment. The port-containing cone member has an intake or inlet port located in the inlet segment and a discharge port located in the discharge segment. The cone seal segment is the area of the cone wall located between a closing edge or trailing edge of the discharge port and opening edge or a leading edge of the inlet port.

Seal water serves four purposes. First, as previously described, seal water forms the cylindrical liquid ring which performs like working pistons that compress the gaseous medium in the liquid ring vacuum pump and forces the compressed gas out of the pump. Second, seal water acts as a heat transfer vehicle to remove the heat of compression that is generated by the compressing action of the liquid ring vacuum pump. Third, seal water forms a seal between the high-pressure gas being discharged from the pump and the low-pressure gas entering the pump. The seal is formed in an approximate 30 degree segment of the cylindrical liquid ring where the liquid ring pistons contact the outer cone wall surface of the port-containing cone member. Preferably, the cylindrical liquid ring pistons exactly intersect and fully contact the cone wall surface without wasteful hindrance of an air flow through the inlet port or excessive discharge of seal water at the discharge port. Finally, seal water lubricates the packing rings around the shaft of the rotor housing.

The operating capacity of the liquid ring vacuum pump, as well as its efficiency, depends upon the integrity of the seal created between the cylindrical piston ring or cylindrical liquid ring and the port-containing cone member at the cone seal segment. An improper intersection of the cylindrical piston ring with the outer cone wall surface can restrict the amount of low pressure gas which can freely enter the inlet port, thereby reducing pump capacity. Also, an improper intersection of the cylindrical piston ring with the outer cone wall surface can restrict the amount of high pressure gas which can freely exit the discharge port, thereby reducing pump capacity and increase power required or worsen efficiency. Therefore, to maximize pump capacity, while minimizing operating cost, it is desirable to have a cone seal segment that fully supports the cylindrical liquid ring or piston ring.

The cone seal segment on the cone wall of an existing port-containing cone member typically has a delta wing port configuration. Because the edges of the ports of "delta wing cone members" do not align with the parabolic shape defined by the intersection of the cylindrical liquid ring with the cone wall surface, a delta wing cone member does not fully support the cylindrical liquid ring. Consequently, delta wing cone members allow cylindrical piston ring liquid to flow into the inlet port and thereby restrict the free flow of air or gas into the inlet port. Additionally, delta wing cone members allow unsupported amounts of the cylindrical piston ring liquid to flow into the discharge port of the port-containing cone member, thereby restricting the flow of compressed gas out of the pump, wastefully discharge seal water out of the pump, and require extra power.

The inflow of fugitive cylindrical ring liquid into the ports of the delta wing cone member decreases the available volume inside the cone member. The reduction of the available volume in the port-containing cone member diminishes the capacity of the liquid ring vacuum pump.

Furthermore, because the cylindrical liquid ring must be maintained at an optimal level in the rotor in order for the pump to operate properly, unnecessary losses of the cylindrical liquid ring, beyond that needed to remove the heat of compression, must be replaced. This requirement for replacing unnecessarily lost seal water increases the operating cost of the liquid ring vacuum pumps.

A need, therefore, exists for a port-containing cone member having inlet and discharge port edges which provides a cone seal segment that fully supports liquid ring pistons located over the cone seal segment and thereby prevents the excessive flow of liquid into the discharge port and the movement of liquid into the inlet port and optimizes the volume of gas entering the inlet port.

SUMMARY OF THE INVENTION

The present invention is a port-containing cone member for a liquid ring vacuum pump having port edges that form a cone seal segment that fully supports the cylindrical liquid ring pistons intersecting the cone.

The invented port-containing cone member has an inlet port and a discharge port defining the edges of the seal of the port-containing cone member. A leading or opening edge of the inlet port is positioned adjacent to a trailing or closing edge of the discharge port. The inlet port has a larger area than the discharge port based on pre-determined compression ratios. Between the discharge port and the inlet port is the cone seal segment. Equidistant between the opening edge of the inlet port and the closing edge of the discharge port is a transition centerline, which bisects the cone seal segment.

The moving cylindrical liquid ring intersects the cone member primarily at the point where the cone member is closest to the pump housing wall. The intersection of the cylindrical liquid ring and the outer surface of the frustoconical port-containing cone member, when laid out in two-dimensional view, is a parabolic shaped area. The parabolic shape of the liquid-cone member contact surface where the cylindrical liquid ring intersects the cone member has a focal point near a middle of the length of the cone of the port-containing cone member and is centered on the transition centerline. The parabola opens toward the large base end of the port-containing cone member. The apex of the parabola extends to a point near the smaller end of the port-containing cone member.

In a preferred embodiment of the present invention, the opening edge of the inlet port and the closing edge of the discharge port track the shape of the parabola formed by the intersection of the cylindrical liquid ring and the frustoconical shape of the port-containing cone member. As a consequence, the cone seal segment of the invented cone member fully supports the cylindrical liquid ring. Preferably, the remaining edges of the inlet and discharge ports are substantially rectangular in shape and have filleted corners. When the port-containing cone member is laid out flat, a parabola can be drawn of the cone seal segment using the adjacent edges of the inlet and discharge ports. This parabola matches the flattened two-dimensional shape of the liquid-cone member contact surface where the cylindrical liquid ring intersects the cone member.

The parabolic shaped port edges give the cone seal segment of the invented port-containing cone member the capability of fully supporting the moving cylindrical liquid ring. The invented cone member prevents the flow of unsupported liquid into the discharge port and also prevents unsupported liquid from entering the inlet port. As a consequence, the amount of liquid needed to operate the pump is reduced to result in a decrease in pump operating costs of water and energy and the amount of air flowing through the pump is not restricted by an unnecessary flow of seal water through the ports.

In addition to preventing fugitive liquid from entering the cone member and occupying air displacement volume, the invented cone member provides a less obstructed pathway for the displacement of air through the port-containing cone member. Consequently, the capacity of the pump is increased as the amount of air being displaced through the port-containing cone member is maximized.

OBJECTS OF THE INVENTION

The principal object of the present invention is to provide a port-containing cone member having port edges shaped to allow a higher level of air displacement through the liquid ring vacuum pump.

Another object of the invention is to provide a port-containing cone member that reduces the unnecessary flow of liquid from the cylindrical liquid ring into the ports of the port-containing cone member.

Another object of the invention is to provide a port-containing cone member that reduces the loss of seal water from the cylindrical liquid ring through the discharge ports of the port-containing cone member.

Another object of the invention is to provide a port-containing cone member which provides an optimal amount of gas displacement through the port-containing cone member.

Another object of the invention is to provide a port-containing cone member which maximizes the liquid ring vacuum pump operating capacity.

Another object of the invention is to provide a port-containing cone member which minimizes the liquid ring vacuum pump operating costs of water and energy.

BRIEF DESCRIPTION OF THE DRAWINGS

The foregoing and other objects will become more readily apparent by referring to the following detailed description and the appended drawings in which:

FIG. 5 is a two-dimensional layout of a port-containing cone member according to a preferred embodiment of the present invention including a cone seal segment having a parabolic shape which corresponds to the parabolic shape of the contact surface defined by the intersection of the cylindrical liquid ring with the frustoconical cone member.

FIG. 6 is a perspective view of the port-containing cone member of FIG. 5 illustrating the parabolic shape of the opening edge of the inlet port.

FIG. 7 is an elevation view of the port-containing cone member of FIG. 5.

FIG. 8 is a two-dimensional layout of an alternative embodiment of a port-containing cone member according to the present invention wherein all or part of the opening edge of the inlet port and all or part of the closing edge of the discharge port are tangential to the parabolic contact surface defined by the intersection of the cylindrical liquid ring with the frustoconical cone member.

DETAILED DESCRIPTION

Figure 1:
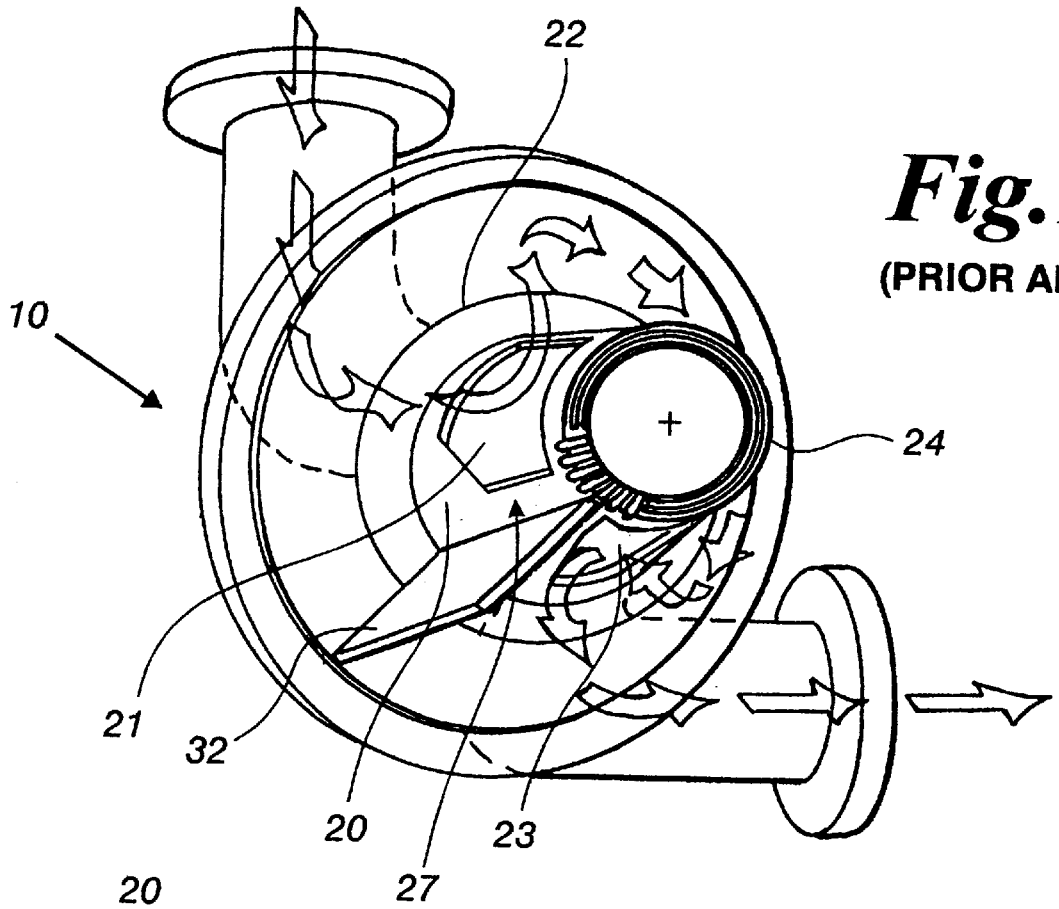
Fig.1 (PRIOR ART)
FIG. 1 is a perspective view of a conventional liquid ring vacuum pump including a delta-wing port-containing cone member having an inlet port and a discharge port.
Figure 2:
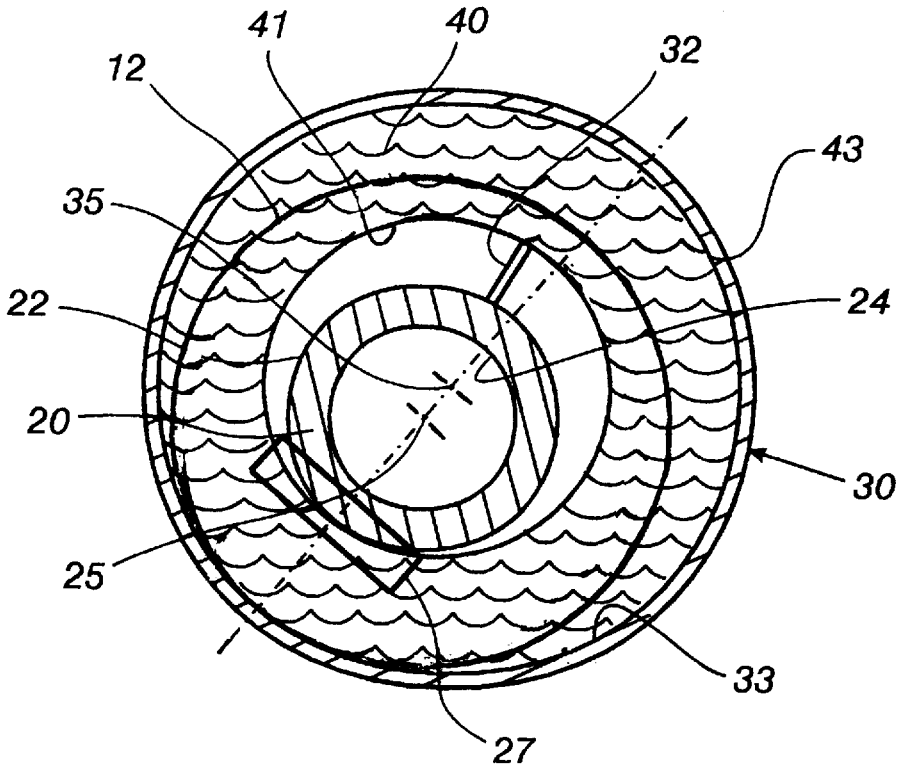
FIG. 2 is a schematic cross sectional view of a cylindrical liquid ring and a cone member showing the location of the seal segment and the transition axis.

Referring now to the drawings, FIGS. 1 and 2 show a liquid ring vacuum pump 10 having a housing 30 and a delta-wing port cone member 20 positioned in a rotor 12. The rotor 12 is mounted in the off-center housing 30. The cone member 20 has a large diameter base end 22 and a smaller diameter end 24. A cone wall 26 extends from the large base end 22 to the smaller end 24. The cone wall 26 is tapered from the large base end 22 to the smaller end 24 thereby giving the cone member 20 a frustoconical shape, the cone wall having an inlet port 21 and a discharge port 23.

The outer surface of the cone member 20 located between the discharge port 23 and the inlet port 21 is defined as the cone seal segment 27 (FIGS. 1 and 2).

Figure 4:
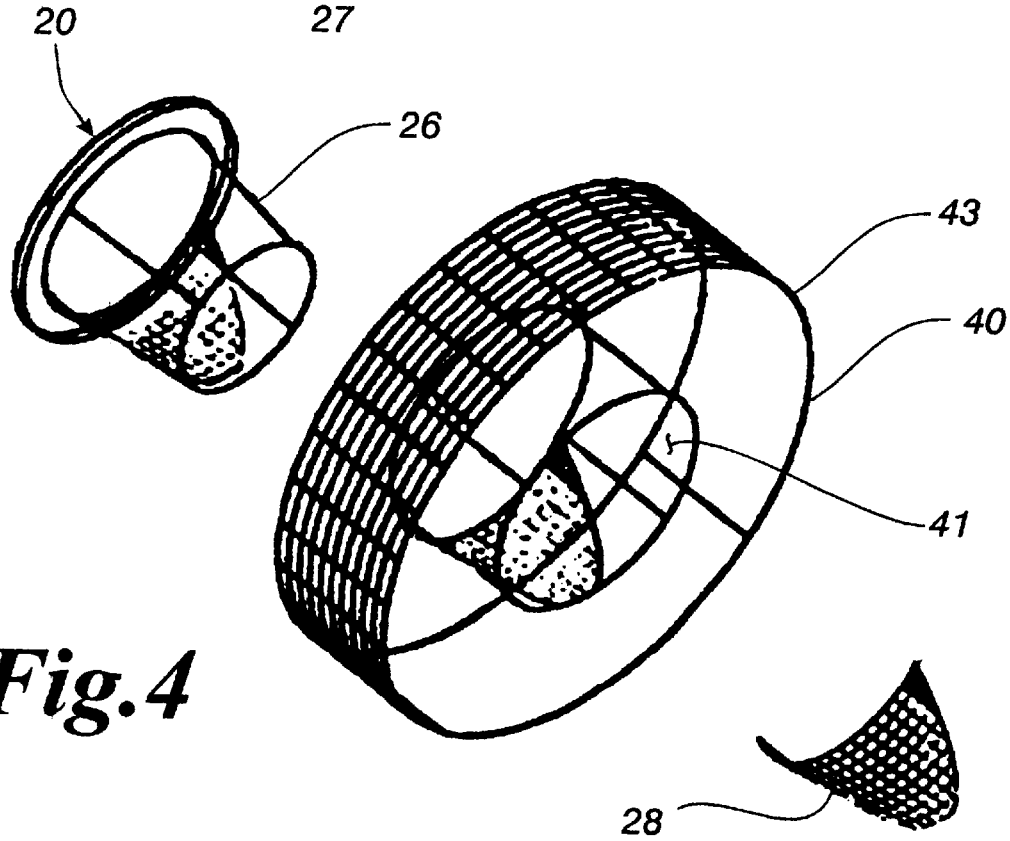
FIG. 4 is an exploded perspective view of a cylindrical liquid ring and a cone member illustrating the location and shape of the contact surface defined by the intersection of the off-center cylindrical liquid ring with the frustoconical cone member in accordance with the invention.

The cone member 20 is positioned on-center with respect to the rotor 12. Housing 30 (FIG. 2) which is positioned with its center of rotation off-center relative to the center (FIG. 2) of the pump rotor 12. Accordingly, the rotor 12 revolves about the cone member 20 within the pump off-centered housing 30. Rotor 12 has a plurality of vanes 32, making an impeller, extending outwardly from the rotor center. Rotation of the rotor 12 causes the vanes to force the seal water to form a cylindrical liquid ring 40 shaped by the housing 30 (FIGS. 2 and 4). As the rotor 12 rotates about the cone, liquid located in the housing forms a cylindrically shaped liquid ring 40 which moves off-centered around cone member 20. The cylindrically shaped liquid ring 40 has an outside diameter 43 and an inside diameter 41.

A solid geometry description of the invention in FIG. 4 shows the liquid ring 40 off-center with respect to frustoconical cone member 20, in which the cone interferes with the inner cylindrical surface of the liquid ring, establishing a series of points forming a line of intersection between the cone and ring, which is a parabola.

The intersection of the moving inner surface 41 of the cylindrical liquid ring 40 and the frustoconical cone wall 26 has a parabolic shape 50 when laid out flat and viewed in two-dimensional space. The surface of the cone wall corresponding to the intersection of the inside diameter 41 of the moving cylindrical liquid ring 40 and the frustoconical cone wall 26 is a liquid-cone member contact surface 28.

In operation, the cylindrical liquid ring 40 performs like a number of working pistons to compress and reduce the volume, and thereby increase the pressure, of a gaseous medium within the liquid ring vacuum pump 10. The resulting pressure differential forces the gaseous medium to be positively displaced from the inlet port 21 of the cone member 20, compressed by the cylindrical liquid ring 40 and then forced out through the discharge port 23 of the cone member.

Figure 3:
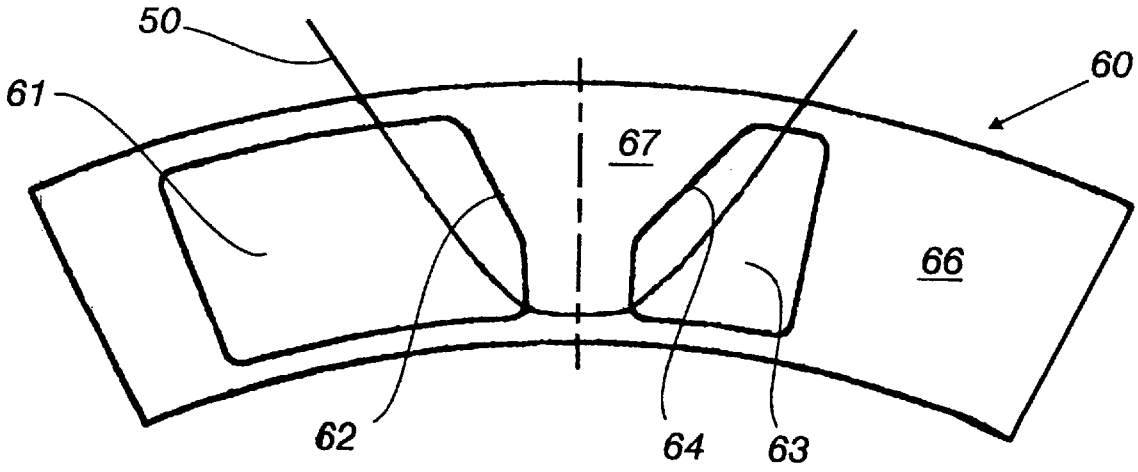
FIG. 3 is a two-dimensional pattern of a prior art delta wing port-containing cone member illustrating the shape of the cone seal segment on the cone wall with an overlay of the parabolic contact surface defined by the intersection of the cylindrical liquid ring with the frustoconical cone member in accordance with the invention.
Figure 9:
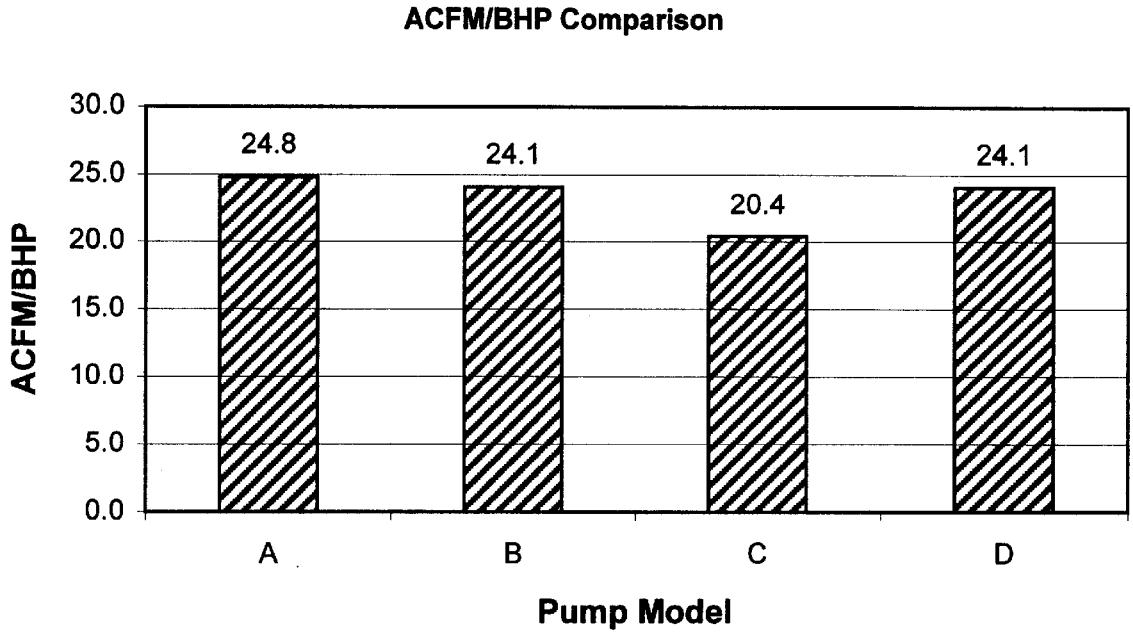
FIG. 9 is a bar graph comparing Actual Cubic Feet per Minute per Brake Horsepower (ACFM/BHP) of PUMP A, which utilizes a cone in accordance with the present invention, with three competitive pumps, PUMPS B, C, and D.
Figure 10:
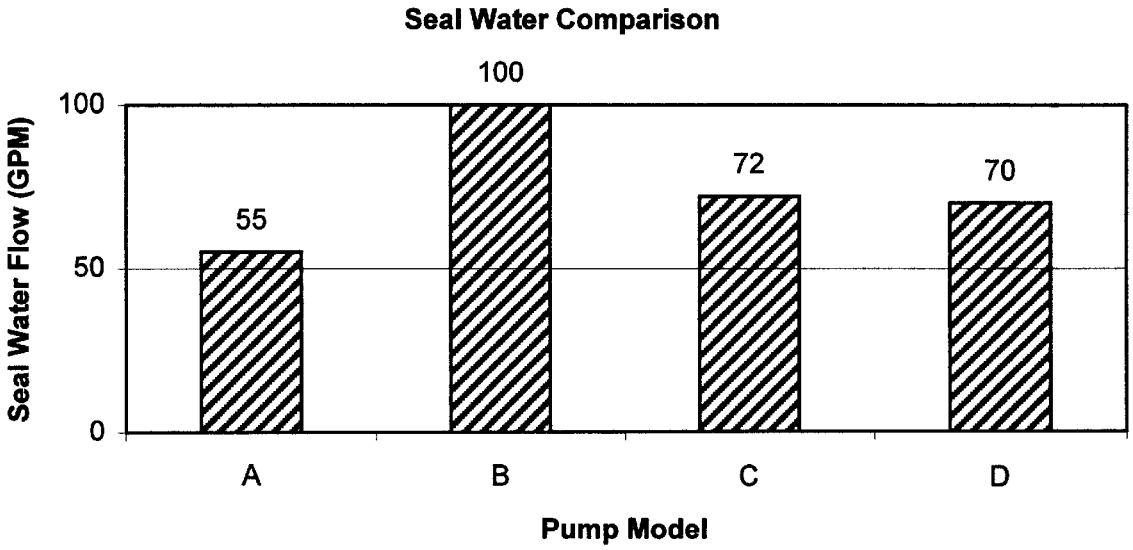
FIG. 10 is a bar graph comparing the required seal water flow in the same four pumps.
Figure 11:
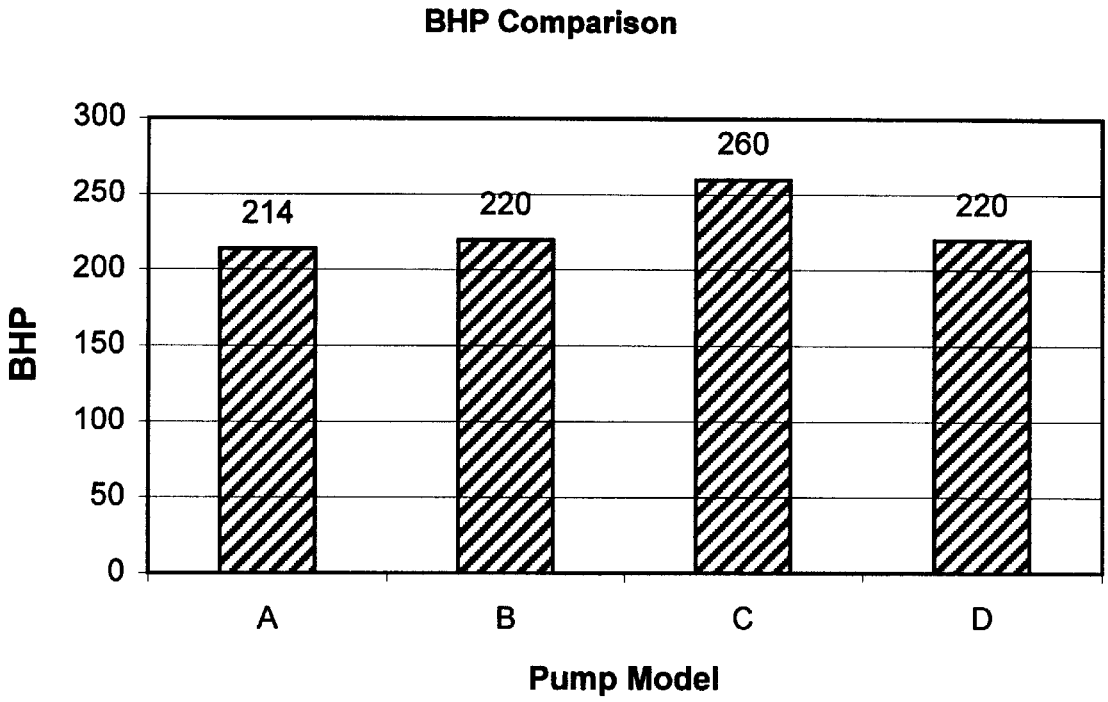
FIG. 11 is a bar graph comparing the brake horsepower consumed by the same four pumps operating at 5300 ACFM and 20 inches of Mercury vacuum ("HgV").
Figure 12:
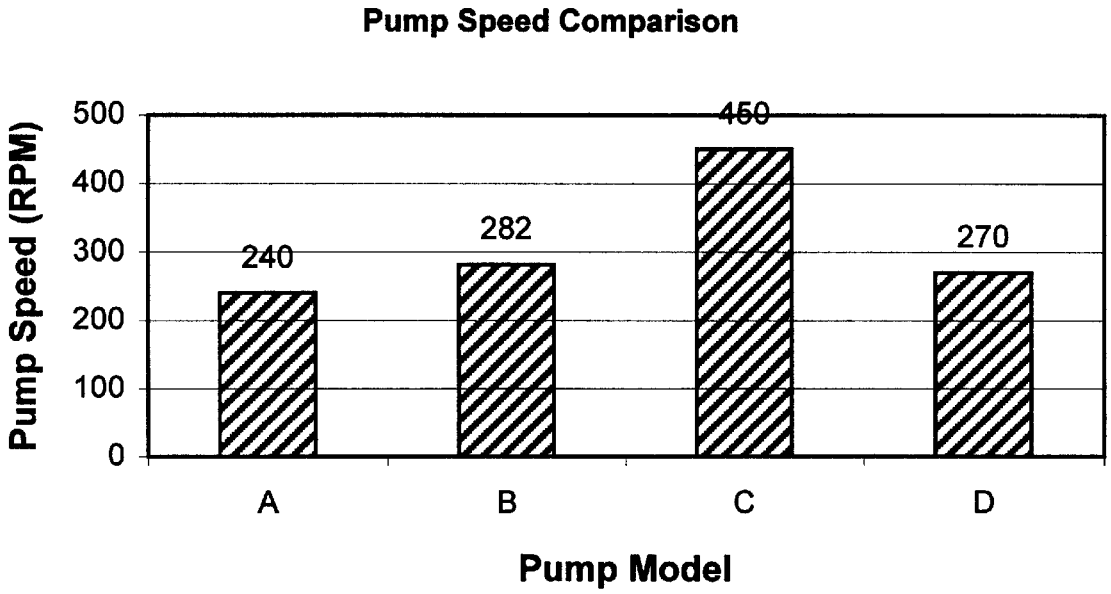
FIG. 12 is a bar graph comparing pump rotational speed required to achieve 5300 ACFM at 20 inches of Mercury vacuum ("HgV").
Figure 13:
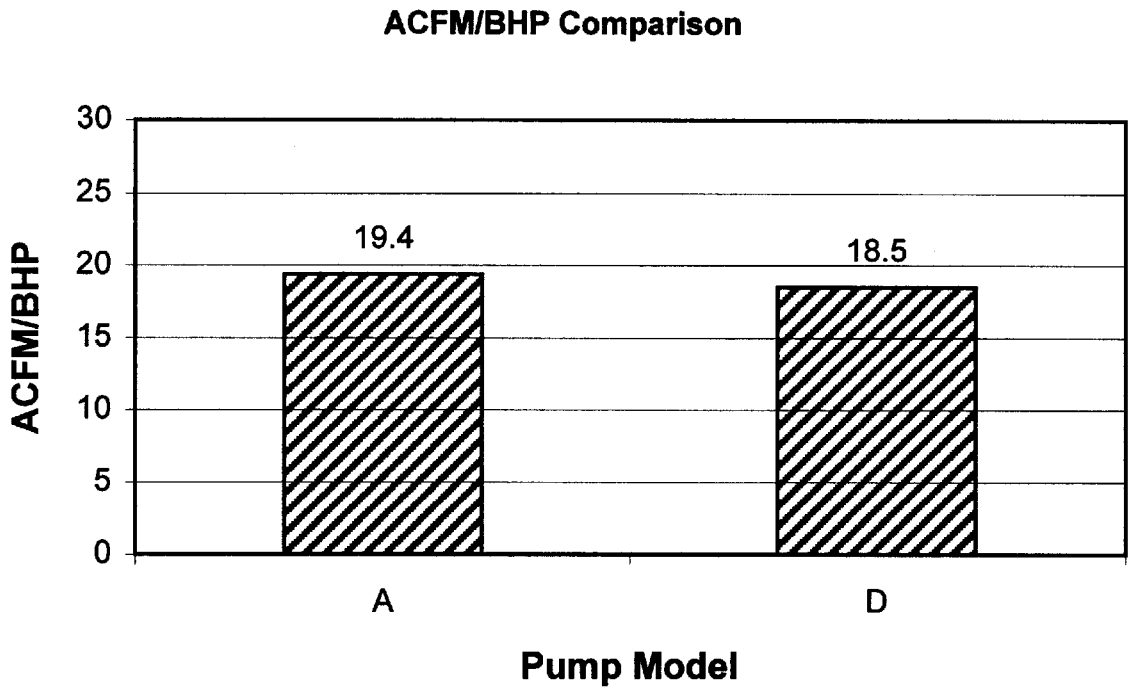
FIG. 13 is a bar graph comparing actual cubic feet per minute per brake horsepower (ACFM/BHP) of PUMP A with that of PUMP D.
Figure 14:
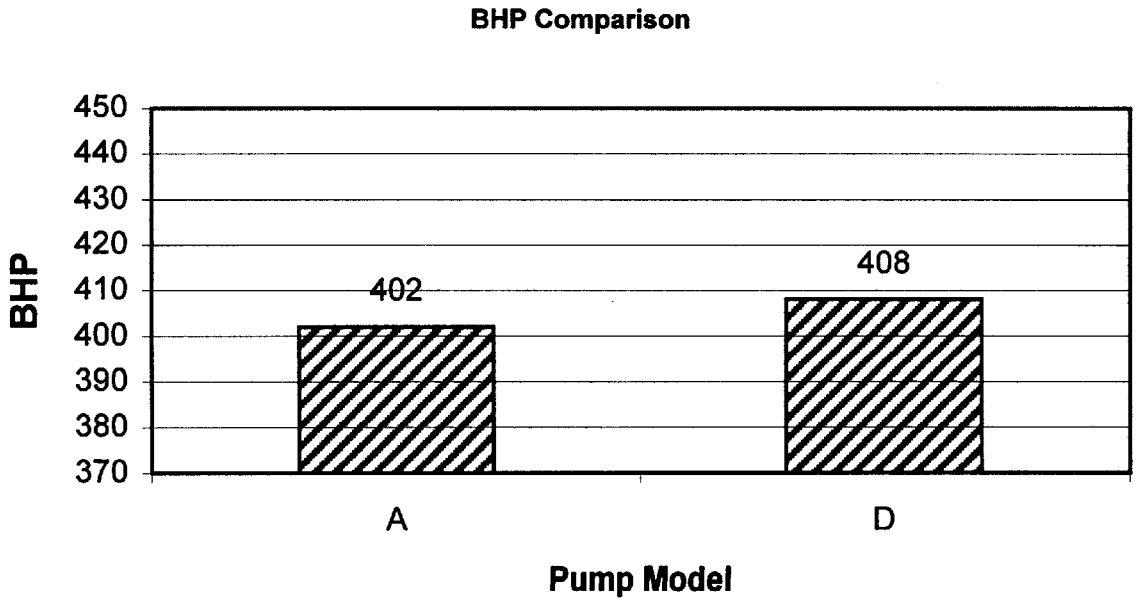
FIG. 14 is a bar graph comparing the brake horsepower of PUMP A of the present invention with that of PUMP D.
Figure 15:
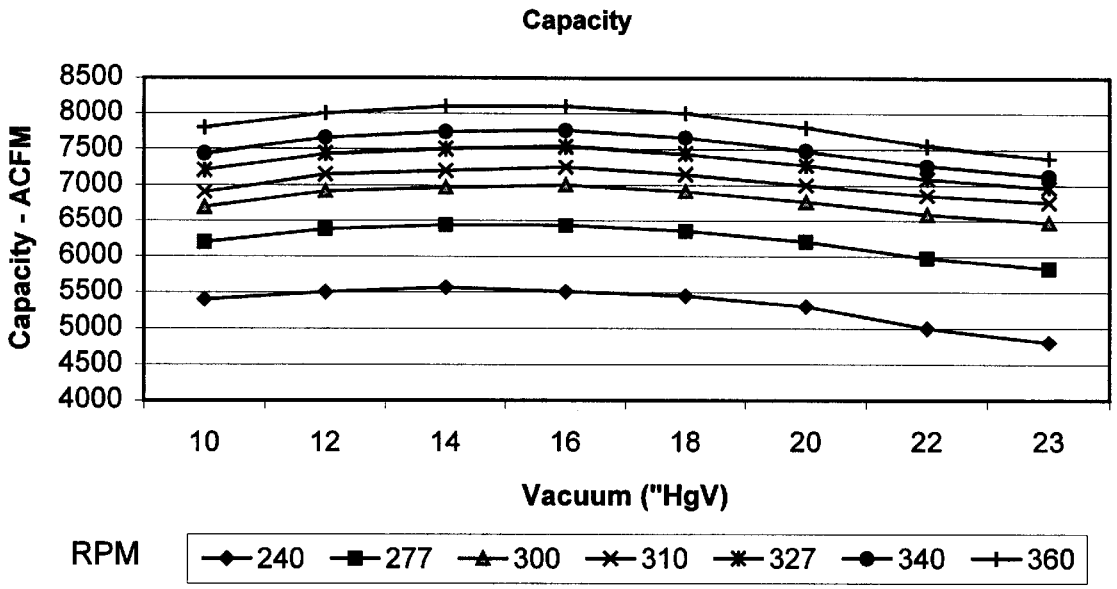
FIG. 15 is a graph of the capacity of PUMP A, having a cone in accordance with the present invention, at various speeds and at various vacuum levels.
Figure 16:
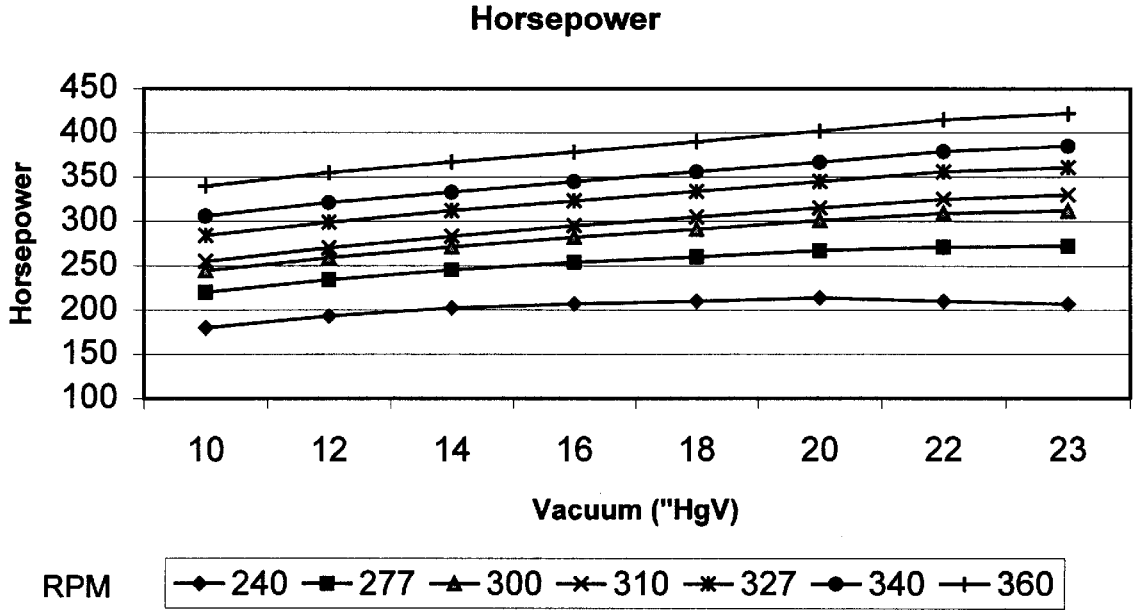
FIG. 16 is a bar graph showing the horsepower required by PUMP A, having a cone in accordance with the present invention, at various speeds and at various vacuum levels.

FIG. 3 is a two-dimensional layout of a prior art "delta wing" shaped cone seal segment 67 of port-containing cone member 60 with the parabolic contact surface of the invention overlaid, the parabolic shape 50 of the contact surface 28 being defined by the intersection of inner surfaces 41 of the cylindrical liquid ring 40 with the outer surface of the cone wall 66 of the frustoconical cone member 60. The delta wing cone member 60 has an inlet port 61 and a discharge port 63 provided in the cone wall 66. In the delta wing cone member 60, an opening (leading) edge 62 of the inlet port 61 is positioned adjacent to a trailing (closing) edge 64 of the discharge port 63 separated by the cone seal segment 67. The opening edge 62 of the inlet port 61 and the closing edge 64 of the discharge port 63 are angled, which gives the cone seal segment 67 a suggestion of a delta wing configuration.

The parabolic shape 50 of the contact surface 28 superimposed on the cone seal segment 67 of the delta wing cone member 60 shows that the opening and closing edges 62, 64 of the inlet and discharge ports 61, 63, respectively, do not align with the parabolic shape 50 of the contact surface 28, thus the cone seal segment 67 of the delta wing cone member 60 does not fully support the entire portion of the inner surface 41 of the cylindrical liquid ring 40 that contacts the delta wing cone member. Consequently, seal water from the cylindrical liquid ring 40 is lost into the inlet and discharge ports 61, 63, and some of the high pressure gas can pass under the liquid ring to return to the inlet side of the pump. This reduces the operating gas flow capacity of the liquid ring vacuum pump 10 while the pump operating cost is increased, particularly costs due to water and energy consumption.

Reduced water usage is caused in the present invention by the closing edge of the of the discharge port preventing wasteful discharge of a portion of the liquid ring as occurs in the delta wing shape. An improved seal is created because the basic shape of the parabola gives more of a segment arc (in degrees) than the delta wing. I.e., the seal is longer than in the delta wing.

The invented seal towards the discharge side is greater than that of the delta wing, thus making a better seal, and the invented seal is enlarged on the inlet side, which makes a better seal, thus the seal is better on both sides or edges of the seal segment. The invention prevents more high pressure gas from passing under the liquid ring to return to the inlet side. In prior art pumps, returning high pressure air prevents some new air from entering the pump, thus decreasing the capacity of the pump.

FIGS. 5, 6, and 7 show a preferred embodiment of a port-containing cone member 70 according to the present invention. The cone member 70 includes a cone seal segment 77 having a generally parabolic shape 79 that corresponds to the parabolic shape 50 of the contact surface 28 defined by the intersection of the inner surface 41 of the cylindrical liquid ring 40 with the frustoconical cone member 70. In particular, FIG. 5 is a two-dimensional layout or pattern of the port-containing cone member 70 illustrating the parabolic shape 79 of the opening edge 72 of the inlet port 71 and the adjacent closing edge 74 of the discharge port 73. Equidistant between the opening edge 72 of the inlet port 71 and the closing edge 74 of the discharge port 73 is a transition centerline 78.

As shown in FIGS. 5–7, the cone member 70 has an inlet port 71 and a discharge port 73 in the cone wall 76 of the cone member separated by a cone seal segment 77. The opening edge 72 of the inlet port 71 and the closing edge 74 of the discharge port 73 coincide with the parabolic shape 50 formed by the intersection of the inner surface 41 of the cylindrical liquid ring 40 with the outer surface of the cone wall 76 of the frustoconical port-containing cone member 70. As a consequence, the cone seal segment 77 of the cone member 70 fully supports the inner surface 41 of the cylindrical liquid ring 40. Preferably, the remaining three edges of the inlet and discharge ports 71, 73 are substantially perpendicular to each other and may have small fillet radius corners such that these three edges of the inlet and discharge ports suggest a generally rectangular shape.

The desired shape of the opening edge 72 of the inlet port 71 and the closing edge 74 of the discharge port 73 is determined by the solid geometrical definition of the profile of the intersection of the inner surface 41 of the cylindrical liquid ring 40 with the frustoconical cone member 70.

The outline of the inner surface 41 of the cylindrical liquid ring 40 on the cone wall 76 of the cone member 70 is found where the inside diameter 41 of the liquid ring intersects the outside surface of the cone member.

FIG. 8 is a two-dimensional pattern of an alternative embodiment of a port-containing cone member 80 according to the present invention. The angled opening edge 82 of the inlet port 81 and the angled closing edge 84 of the discharge port 82 are tangential to the parabolic shape 50 of the contact surface 28 defined by the intersection of the inner surface 41 of the cylindrical liquid ring 40 with the frustoconical cone member 80. Similar to the preferred embodiment illustrated in FIGS. 5–7, the opening and closing edges 82, 84 of the inlet and discharge ports, 81, 83, respectively, of the cone member 80 approximate the desired parabolic shape 50 so that the cone seal segment 87 of the port-containing cone member 80 fully supports the inner surface 41 of the cylindrical liquid ring 40. Again, the operating gas flow capacity of the liquid ring vacuum pump 10 is maximized while the operating cost of water and power is minimized.

Both embodiments support the cylindrical liquid ring 40 and therefore achieve the advantages of the present invention.

Some of the water from the liquid ring discharges in a splashing manner out of the discharge port, which is necessary to remove the heat of compression. However, the present invention reduces the amount of water being discharged in this manner by about 40%, since the seal is more supporting than prior seals, preventing unnecessarily wasteful discharge of water from the inner surface of the liquid ring.

Reducing wasteful discharge of water also reduces the amount of power required by the pump. This is evidenced by the reduced power consumed and reduced ACFM/BHP, which is shown in Table I.

TABLE I

| Operating Conditions | PUMP A | PUMP B | PUMP C | PUMP D |
|---|---|---|---|---|
| Capacity (ACFM) | 5300 | 5300 | 5300 | 5300 |
| Vacuum Level ("HgV) | 20 | 20 | 20 | 20 |
| Pump Speed (RPM) | 240 | 282 | 450 | 270 |
| Horsepower BHP | 214 | 220 | 260 | 220 |
| ACFM/BHP | 24.8 | 24.1 | 20.4 | 24.1 |
| Seal Water Flow (GPM) | 55 | 100 | 72 | 70 |
| Improvement, % | — | 45 | 24 | 21 |

Table I shows that for the same airflow at the same vacuum level in Pumps A, B, C and D, the invented pump operates at slower speed, requiring less brake horsepower has the best ACFM/BHP, and requires less seal water. Seal water usage reduction is from 20 to 45 percent.

Table 2 shows that comparing Pump A with Pump D, consuming about same brake horsepower, Pump A has greater airflow, operates at slower speed, and requires less seal water than Pump D.

TABLE 2

| Operating Conditions | PUMP A | PUMP D |
|---|---|---|
| Horsepower (@ vacuum) | 402 | 408 |
| Pump Speed (RPM) | 360 | 400 |
| Capacity (ACFM) | 7800 | 7550 |
| Vacuum Level ("HgV) | 20 | 20 |
| ACFM/BHP | 19.4 | 18.5 |
| Seal Water Flow (GPM) | 55 | 70 |

SUMMARY OF THE ACHIEVEMENT OF THE OBJECTS OF THE INVENTION

From the foregoing, it is readily apparent that I have invented an improved port-containing cone member for use in a liquid ring vacuum pump, where the opening edge of the inlet port and the closing edge of the discharge port each have a parabolic shape which corresponds to the geometric shape of the intersection of the inner surface of the cylindrical liquid ring and the outer surface of the wall of the frustoconical cone member. The invented cone member thus fully supports the inner surface of the cylindrical liquid ring and prevents excessive amounts of liquid from entering the discharge port or falling into the intake port.

In addition, the absence of unsupported liquid entering the ports of the invented port-containing cone member also allows for the displacement of air through the ports to be maintained at an optimal level. The present invention provides a port-containing cone member that improves the optimal displacement of air through the liquid ring vacuum pump and increases the positively-displaced air-moving capacity of the pump.

The present invention provides a port-containing cone member that fully supports the inner surface of the cylindrical liquid ring and prevents unsupported liquid from flowing into the discharge port or falling into the inlet port. The present invention provides an improved port-containing cone member that reduces the operating expense of water used for running the liquid ring vacuum pump by using less liquid to operate the pump. The present invention provides a port-containing cone member that reduces waste of energy and seal water consumed by the liquid ring vacuum pump caused by water entering into the inlet port and pumped out of the discharge port.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A liquid ring vacuum pump or compressor, comprising:

a cylindrical housing having a longitudinal axis;

a rotor having an axis of rotation, said housing being off-center with regard to said rotor;

a frustoconical shaped port-containing cone member positioned on-center in said rotor, said cone member having an inlet port having a partial parabolic shaped opening edge and a discharge port having a partial parabolic shaped closing edge, said closing edge being adjacent said opening edge; and a cylindrical liquid ring form by movement of liquid around said cone member wherein said liquid ring intersects said frustoconical cone member;

wherein said parabolic shaped opening edge and said parabolic shaped closing edge approximate outer edges of a liquid-cone member seal segment contact surface.

2. An improved port-containing cone member for preventing the flow of liquid into the cone member and for improving gas displacement through the cone member, comprising:

a cone wall, said cone wall having an inlet port and a discharge port, said inlet port having an opening edge, said discharge port having a closing edge adjacent said opening edge; and cone member having a frustoconical shape and the liquid-cone member seal segment contact surface has a parabolic intersection shape defined by solid geometry;

wherein said opening edge and said closing edge approximate outer edges of a liquid-cone member seal segment contact surface, such surface being that where an inner surface of an off-centered cylindrical liquid ring formed by movement of a rotor around the cone member intersects the cone member.

3. The cone member of claim 1, wherein said opening edge of said inlet port is a curved edge tracking the parabolic intersection shape.

4. The cone member of claim 1, wherein said closing edge of said discharge port is a curved edge tracking the parabolic intersection shape.

5. The cone member of claim 2, wherein said opening edge of said inlet port is a straight edge forming a tangent to the parabolic intersection shape.

6. The cone member of claim 2, wherein said closing edge of said discharge port is a straight edge forming a tangent to the parabolic intersection shape.

7. The cone member of claim 2, wherein said opening edge of said inlet port is a straight edge forming a tangent to the parabolic intersection shape and wherein said closing edge of said discharge port is a straight edge forming a tangent to the parabolic intersection shape.

8. The cone member of claim 2, wherein said inlet port is larger than said discharge port.

9. A port-containing cone member for a liquid ring vacuum pump, said cone member comprising:

a larger diameter base end;

a smaller diameter end opposite said larger diameter base end; and a cone wall extending between said larger diameter base end and said smaller diameter end so that said cone member has a frustoconical shape, said cone wall having an inlet port and a discharge port formed therein separated by a cone seal segment, said inlet port comprising an opening edge and said discharge port comprising a closing edge;

wherein each of said opening and closing edges approximates the outer edges of a contact surface defined by the intersection of an inner surface of a cylindrical liquid ring with said cone member; and wherein at least one of said opening edge of said inlet port and said closing edge of said discharge port has a parabolic shape.

10. A port-containing cone member according to claim 9 wherein said cone seal segment fully supports said contact surface thereby increasing the positive displacement of a gas through a liquid ring vacuum pump.

11. A liquid ring vacuum pump comprising:

a cylindrical housing having a longitudinal axis;

a rotor having an axis of rotation positioned within said housing, said housing being off center with regard to said rotor;

at least one port-containing cone member located within said rotor, the longitudinal axis of said cone member aligned with the longitudinal axis of said rotor so that said rotor revolves about said cone member, said cone member comprising a larger diameter base end;

a smaller diameter end opposite said larger diameter base end; and a cone wall extending between said larger diameter base end and said smaller diameter end so that said cone member has a frustoconical shape, said cone wall having an inlet port and a discharge port formed therein separated by a cone seal segment, said inlet port comprising an opening edge and said discharge port comprising a closing edge;

wherein each of said opening and closing edges approximates the outer edges of a contact surface defined by the intersection of the inner surface of a cylindrical liquid ring with said cone member; and wherein at least one of said opening edge of said inlet port and said closing edge of said discharge port has a parabolic shape.

12. A liquid ring vacuum pump according to claim 11 wherein at least one of said opening edge of said inlet port and said closing edge of said discharge port is tangential to an outer edge of said contact surface.

13. A method of reducing water usage in a liquid ring vacuum pump having a port-containing cone member having a gas inlet port and a gas discharge port, the cone being situated within a vane-containing rotor, comprising:

providing a parabolic shaped opening edge to the inlet port and a parabolic shaped closing edge in the discharge port of the cone, which approximate outer edges of a liquid-cone member seal segment contact surface.

* * * * *